United States Patent [19]

Russell et al.

[11] 4,126,905

[45] Nov. 28, 1978

[54] FLOATING THERAPY POOL

[75] Inventors: Clayton C. Russell, York, Pa.; Donald H. Witte, Detroit, Mich.

[73] Assignee: Fox Pool Corporation, York, Pa.

[21] Appl. No.: 796,980

[22] Filed: May 16, 1977

[51] Int. Cl.[2] ..... A47K 3/18; A47K 3/16

[52] U.S. Cl. ..... 4/172; 4/171; 4/172.16; 4/172.19

[58] Field of Search ..... 4/172, 172.19, 171, 4/172.16; 128/66, 369

[56] References Cited

U.S. PATENT DOCUMENTS

| | | | |
|---|---|---|---|
| 3,043,296 | 7/1962 | Gregory | 128/369 X |
| 3,092,101 | 6/1963 | Kinney | 128/369 X |
| 3,099,018 | 7/1963 | O'Connell | 4/171 |
| 3,460,166 | 8/1969 | Weber | 4/172 |
| 3,556,089 | 1/1971 | Frazier | 128/66 |
| 3,623,165 | 11/1971 | Whittell, Jr. | 4/172.15 |
| 3,781,925 | 1/1974 | Curtis et al. | 4/172.15 |
| 3,943,580 | 3/1976 | Carter | 4/172.15 |
| 4,001,899 | 1/1977 | Mathis | 4/172 |
| 4,019,210 | 4/1977 | Patterson et al. | 4/172 |

FOREIGN PATENT DOCUMENTS

| | | | |
|---|---|---|---|
| 40,200 | 5/1929 | Sweden | 128/66 |

*Primary Examiner*—Henry K. Artis
*Attorney, Agent, or Firm*—Arthur J. Plantamura

[57] ABSTRACT

A floating therapy apparatus or "spa" is provided which is adapted to be floating in and to utilize the filtration and heating systems of a conventional swimming pool comprising a substantially water impermeable enclosure, which is immersed and supported in a conventional swimming pool, having only the upper peripheral edge of said enclosure above the surface of said pool. A water supply inlet is used to circulate heated filtered water from said pool filtration system into said enclosure, the spa water may be discharged into the main pool and/or a water return may be used to discharge water from the enclosure. Valving means for channelling substantially all or at least a disproportionately high amount of the capacity of the swimming pool water heater water is used as the feed water for said enclosure. An air discharge means in the lower part of said enclosure is employed to introduce air into the enclosure and create pressure waves in said enclosure with suitable air generating means being used for supplying pressurized air into said enclosure through said air discharge opening. The spa heated water requirements comprise a basically closed circulatory system for the heated water. A certain greater percentage of water must be circulated into the spa enclosure than is pulled out by the suction pump to provide make-up water for leakage and to, therefore, maintain an adequate water supply in the spa enclosure to keep it at the desired fill volume.

15 Claims, 11 Drawing Figures

FLOATING THERAPY POOL

The present invention relates to a floating spa or therapeutic pool structure which is used as an accessory to and uses the facilities of an existing swimming pool.

BACKGROUND OF THE INVENTION

Hydrotherapy units which provide aerated heated water for physical therapy or for relaxation, hereafter sometimes referred to as a "spa", are known in the art and in recent years have been in increasing demand because of their recognized beneficial impact on users. In many cases, therapeutic devices of this kind are medically prescribed for persons with physical impairments who, because of such impairment, have difficulty in travelling to a therapy center away from home. Thus, the availability at moderate cost of a therapy unit as an accessory to a conventional private pool, would be a definite advantage. However, the expanded use of such units for private pool owners, whether for health purposes or for relaxation, has been slowed primarily because of the relatively high cost of such devices.

The existence of floating pools per se is known, see for example U.S. Pat. Nos. 3,078,472 and 3,099,018. Various therapeutic units, see for example, U.S. Pat. Nos. 3,092,101 and 3,693,194 are also known. Moreover, attempts have also been made in the prior art to provide therapeutic units as an adjunct to swimming pools and which use the heating systems of the main pool such as U.S. Pat. Nos. 3,623,165, 3,781,925, and 3,837,016. However, no specific unit is known which provides the private pool owner with an inexpensive, portable and yet effective therapy unit which may be readily used with, and removed from, an existing swimming pool and uses the existing facilities thereof, is light in weight, does not alter the integrity of an existing conventional pool, and is reliable and effective in performance. It is thus apparent that a need exists for a therapy unit or health spa which is of low cost and is readily adaptable to be used as an accessory to an existing conventional pool which may be removably installed and used without disturbing the integrity of the conventional pool.

SUMMARY OF THE INVENTION

The present invention provides a therapeutic spa which is portable and of relatively small size, i.e. an enclosure on the order of about 6 to 8 feet in diameter which is adapted to be floated in and connected to the existing conventional swimming pool facilities and into which those desiring the treatment offered by a spa can enter and conveniently derive the benefits of a device of this kind.

The spa of the invention comprises a floatation collar with an attached flexible body membrane and utilizes the water heating, filtering and circulatory components of the parent pool. Flexible lines are run from a pool inlet to the spa body membrane and likewise a suction line is connected from the spa to a suction source of the pool. A primary advantage of the spa of the invention resides in its adaptability to utilize the heated water from a pool heater and concentrate in via an alternate closed circuit in the limited confines of the spa and thereby economically heat this relatively confined area for purposes of the spa without permanently rerouting from the function of the pool heater to heat the main pool. This capability offers a substantial energy conservation feature because the spa utilizes essentially only the heat energy which would normally be used in any case to heat the existing conventional swimming pool. In other words, in the system of the present invention, heated water from the pool heater is concentrated in the spa and obviously as intended there exists a substnatially higher temperature differential in the spa water over the water in the main pool since the water from the heater is concentrated in the spa. However, because of appreciable allowed leakage of water from the spa into the main pool, the main pool essentially benefits in any event from the pool heating system. In a manner of speaking, the spa borrows and uses the heated water from the pool system.

To enable one to more conveniently enter or exit from the spa enclosure, the spa may be secured to the side of the main pool and a portable ladder lowered into the spa. Alternatively, as an entrance/exit into the spa, a railing or support bar may be constructed and affixed either to the pool or the spa to permit safe entry and exit from the deck to the spa area. Suitable seating may also be arranged within the spa confines for convenience and to enhance relaxation and enjoyment of the spa.

Air injected into the spa may be supplied from a suitable source such as from an air blower of a conventional commercially available kind. The air blower induced air is preferably supplied within the spa through peripheral air line runs located at any level in the spa. These air manifold rings may be either separately plumbed or encapsulated for example in a seat/step module insert in the spa. Preferably one air supply source is positioned near the base of the spa. Any suitable weighting means may be used to immerse the spa if the buoyancy of the spa, or the buoyance of the air manifold interferes with the use or proper performance. The weight of the air manifold and/or framing bar at the bottom of the spa serves to maintain the proper geometry of the spa and to define the confines of the water envelope or enclosure.

In essence, the spa comprises a miniaturized arena-like sitting perimeter which may be formed as a modular unit and installed in any area of an existing pool. This spa assembly may be arranged to rest on the bottom of the pool into which it is deposited and may be equipped with stairs, seating, grabrail facilities, air ring facilities, and plumbing orifices. The arrangement and use of the spa water from that of the main pool since some water interchange between the spa and the pool waters would not be objectionable and, in fact, is desirable since the water chemistry requirements can be handled by the needs of the pool without special attention to the spa. It should be further noted that by this arrangement no additional head of water is required in the spa structure. The open edge of the spa structure perimeter perferably extends above the normal water level of the main pool and thereby establishes adequate isolation of the spa water body from the main pool body of water. A modification of the above described embodiment involves inclusions of an added floatation collar around the outer upper perimeter of the spa thereby making it an absolute floating assembly, i.e. even with occupants the spa is buoyant. With proper plumbing considerations, i.e. with flexible tubing for the supply of heated water and circulatory air connections, the spa may be arranged to float around the main pool with occupants in it, affording an added feature that may be preferred by some users.

Accordingly, it is an object of the present invention to provide a floating therapeutic spa which is positioned and floats within and uses the facilities of a conventional swimming pool.

It is another object of the invention to provide a portable therapeutic spa for use with an existing pool's filter and heater.

It is another object of the invention to provide a readily installable low cost therapeutic spa as an advantageous accessory to a conventional swimming pool.

It is a further and important object of the invention to utilize the heating capacity of a conventional pool heater and to concentrate the heating capacity to the advantage that it provide the beneficial heat for a therapeutic pool.

It is another object of the invention to utilize the rate of water interchange capacity available in the main pool to keep the water adequately filtered in the therapy pool enclosure and thereby satisfy the "heavy bather load" in the relatively low-volume therapy spa.

These and other objects of the invention will become apparent from the following description and accompanying drawing.

DESCRIPTION OF THE PREFERRED EMBODIMENTS

Figure 1:
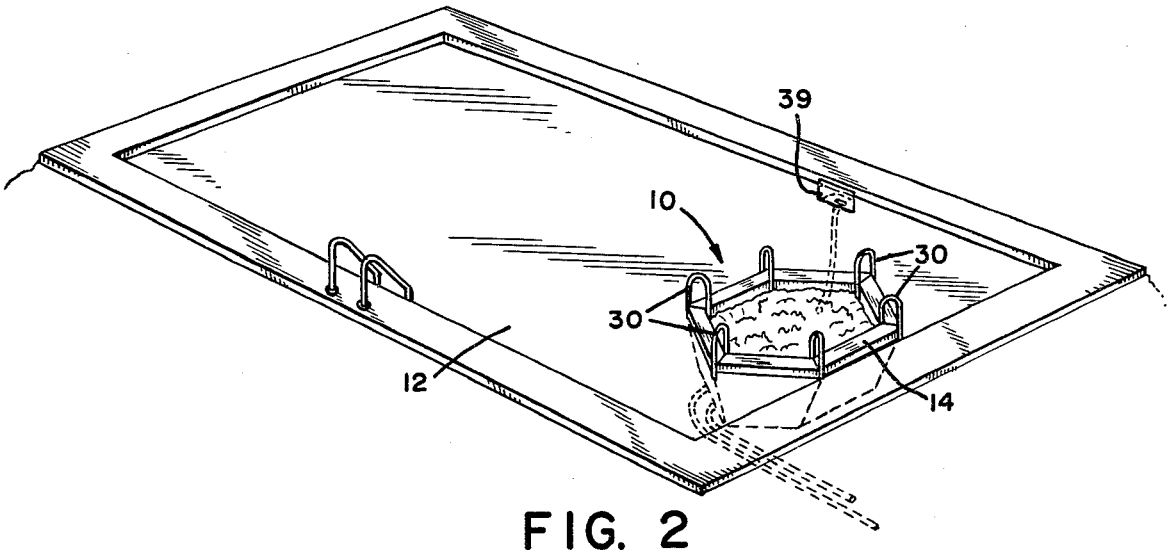
FIG. 1 is a perspective view showing a "floating spa" of the kind contemplated by the invention situated within a swimming pool.

Referring to the figures of the drawing, a floating spa 10 may be positioned within a swimming pool 12 adjacent the deck as shown in FIG. 1. Any suitable or desirable shape can be used such as the hexagonal one shown and illustrated in FIGS. 1 through 5, which may be prefabricated in modules and readily assembled, or a circular, rectangular, square, etc. As shown more clearly in FIG. 2, a hexagonal shaped floatation collar 14 is formed with six interconnecting sections 16. Each section is in the shape of an inverted channel 18 having end pieces 20 which are secured together by any suitable means such as bolts 22 or plastic fasteners, for example. Each section 16 contains a suitable buoyant structure, such as plastic foam material 24 formed to shape or properly secured therein to provide structural integrity.

Figure 2:
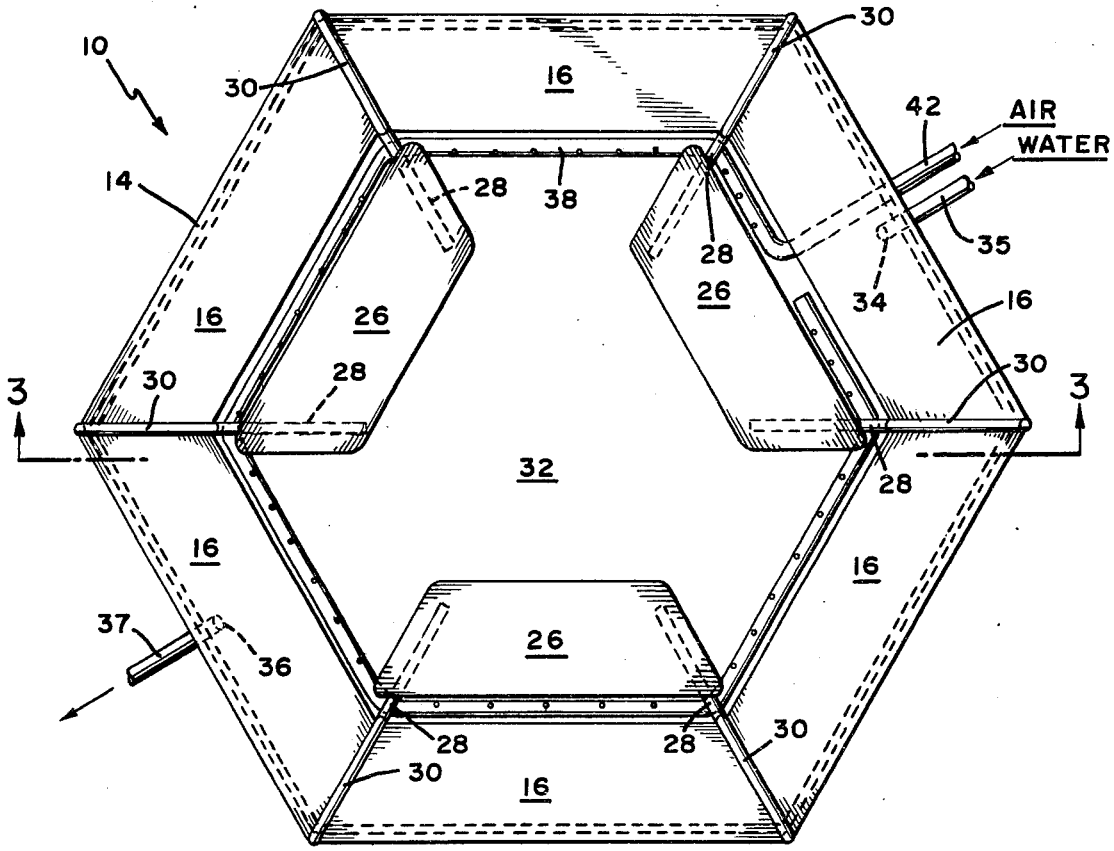
FIG. 2 is a plan view of the spa of the invention.
Figure 3:
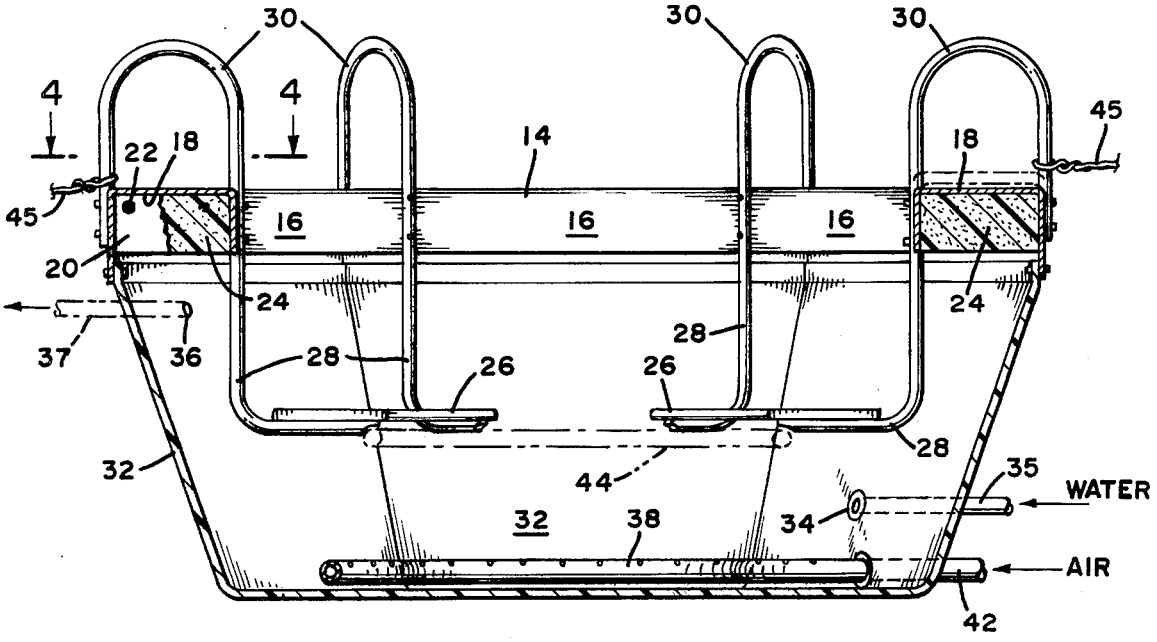
FIG. 3 is a section view taken along line 3—3 of FIG. 2.
Figure 4:
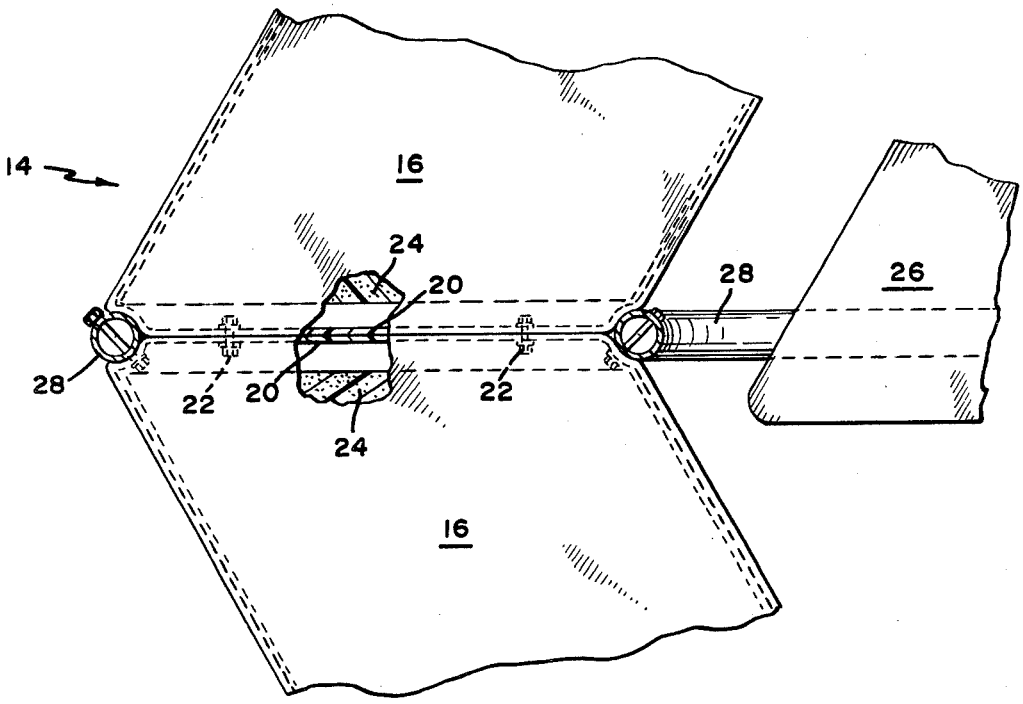
FIG. 4 is a sectional view taken along line 4—4 of FIG. 3.

With particular reference to FIGS. 2 through 4, it will be noted that the hexagonal shape readily lends itself for use with three seats 26 which are supported by tubular members 28 secured to the floatation collar 14 by bolts 15. The seats, of course, can be used also as steps when entering and exiting the spa. The tubular members 28 extend above the collar 14 and the free end is attached to the outside of the collar to form a hand rail 30. The spa body 32 is fabricated from any suitable material such as vinyl plastic which is attached to the lower part of the outer walls of the channels 18.

Figure 5:
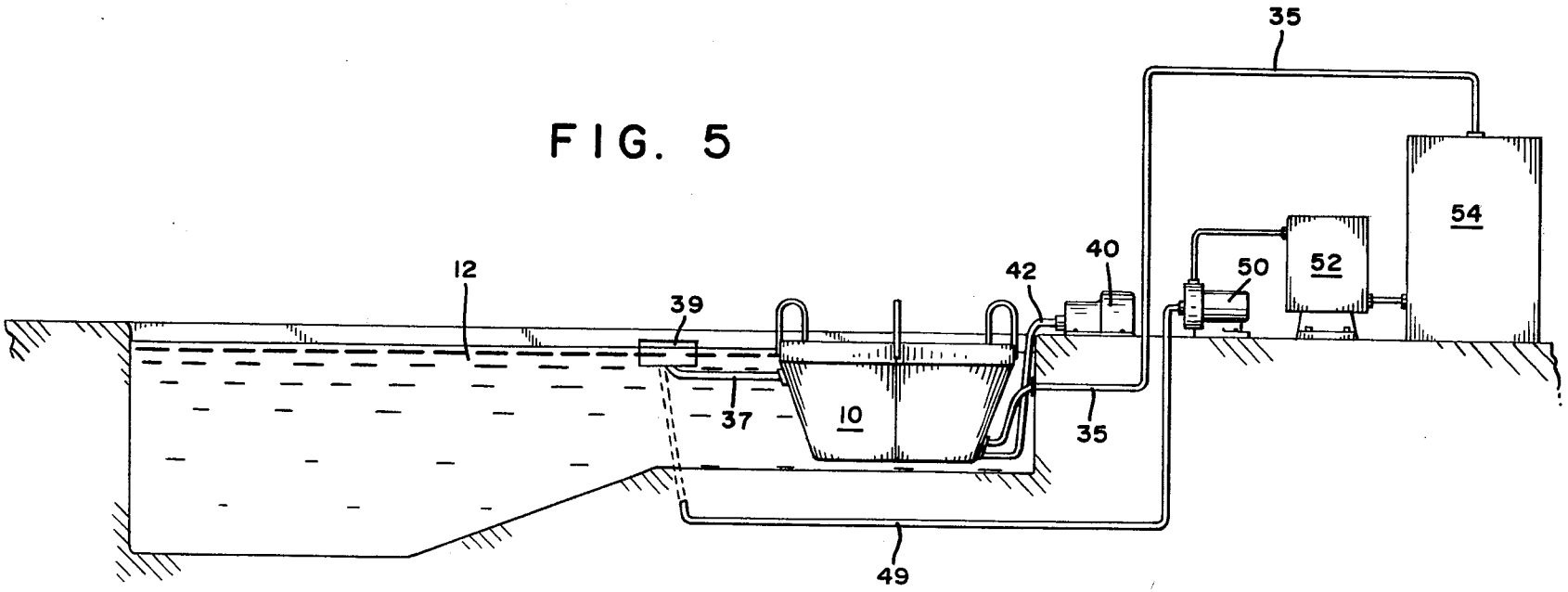
FIG. 5 is an elevational view partly in section of the spa within a pool.

A fitting 34 in the lower portion of the spa body admits water into the spa through a pipe 35 from the pool filtering system, and a similar fitting 36, preferably in the opposite wall adjacent the upper portion, serves to deliver the "used" water back into the system through a pipe 37 and a skimmer or other suction fitting 39 (FIGS. 1 and 5).

A suitable air supply is provided to produce the desired massaging or therapeutic effect, for example, as in the arrangement disclosed in U.S. Pat. No. 3,477,747. As shown in the drawing, an air manifold 38 having spaced holes is placed around the bottom of the spa body to deliver air, preferably of a low pressure and high volume, from a suitable blower 40 which may be any of conventional commercially available units with this capability, for example model No. 101106 supplied by Southern Pacific Industries of Garden Grove, California. The air is supplied through a hose 42 extending through the wall of the spa. An alternate or additional position for the air manifold is indicated at 44 which, if desired, can be an additional manifold.

The spa can be restrained from the possibility of floating freely in too wide an area in any desired manner such as by securing it with one or more mooring lines 45 (or cable or chain) attached to the hand rail 30 as shown in FIG. 3 and secured at the free end to the pool wall or deck (not shown).

The spa is readily adaptable for use with standard pool filtering and circulating systems such as that shown in FIG. 5. Water from the spa 10 is collected at the skimmer 39 and through a pipe 49 is circulated by a pump 50 through a filter 52 and a heater 54 from which it is delivered into the spa 10 through the pipe 35. From the spa, the water is recirculated through the pipe 37 to the skimmer and is returned to the filter and heater again by the pump 50.

We have discovered that the entire hot water return from the pool heater may be introduced into the spa confines. Since energy conservation is an important consideration, the energy saved in providing a substantially smaller heated body of water for therapeutic and/or recreational use as by heating the spa only as opposed to heating the entire pool, is an extremely positive savings advantage. By using the heated water supply capacity intended for the whole pool, in the confines of the spa enclosure, the spa is heated in a relatively short period of time. This affords a definite water temperature differential between the floating spa and the parent pool; this already available heat capacity controlled through the substantially closed circuit of the present invention supplies the therapeutic heat environment. The only deviation from a truly total closed circuit is the permitted leakage of heated water from the spa to the pool.

Although a larger quantity of water must be circulated into the spa enclosure than is returned to the filter heated by the suction connection, this is no problem since a certain quantity of make-up water is picked up in the suction circuit to satisfy a balanced flow through the pump.

Figure 6:
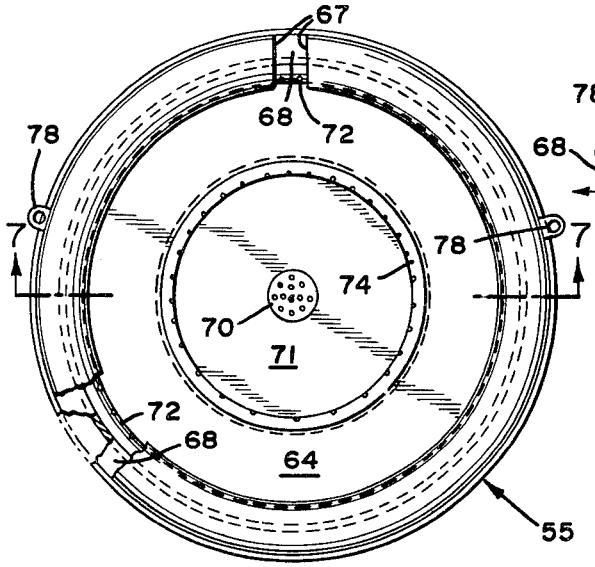
FIG. 6 is a plan view of an alternate shaped spa in accordance with the invention.
Figure 7:
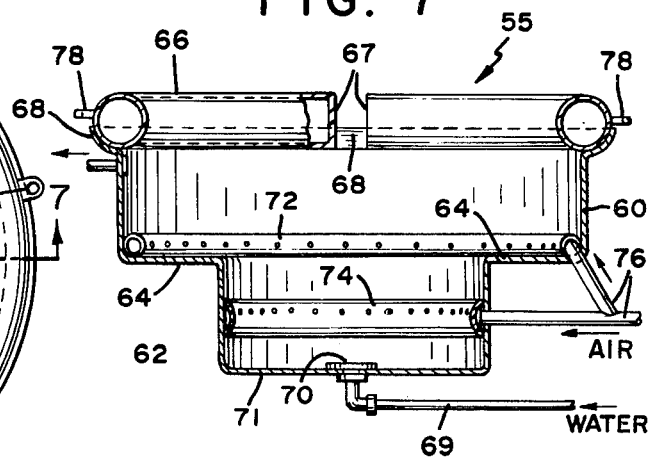
FIG. 7 is a sectional view taken along line 7—7 of FIG. 6.

A modified spa 55, illustrated in FIGS. 6 and 7, has a circular shape. The body 60 is formed with an offset lower portion 62 to provide a sitting area 64. The structure may be formed in a single piece such as by a thermo-form plastic, or by shaping a thermo-form or thermo-set plastic material, such as fiberglass-filled impregnated fiberglass mat resin sheet, e.g. nylon polyester or polycarbonate. A floatation collar 66 of circular crossection is sealed so that the contained air will provide the buoyance required. The collar has spaced-apart ends 67 to provide an overflow for the spa water. The body 60 is attached to the collar 66 by a contoured lip 68 and secured in any suitable manner such as an adhesive. Water is admitted to the spa from the pool circulating system through a pipe 60 connected to an inlet 70 at the bottom 71 of the spa 60. Air is injected into the spa through suitable manifold 72 and 74 which are fed through a pipe 76 from the blower 40. Loops 78 are provided on the collar 66 for attaching a mooring line, (not shown). The lower manifold 74 has one flat side for facilitating attaching to the wall and to minimize the projection into the spa area. The manifolds may also be molded-in channels.

Figure 8:
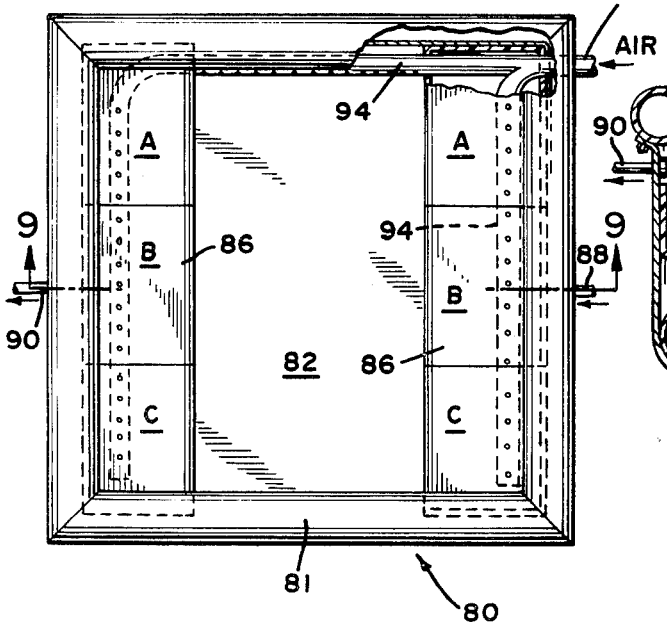
FIG. 8 is a plan view of another modification of a spa according to the invention.
Figure 9:
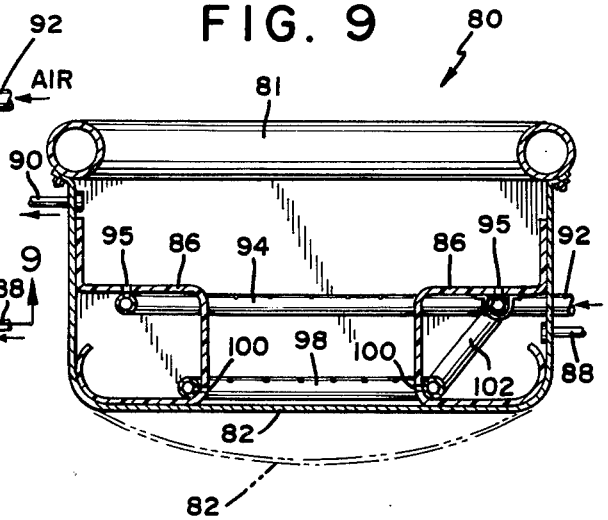
FIG. 9 is a sectional view taken along line 9—9 of FIG. 8.

Another modification 80 is illustrated in FIGS. 8 and 9 wherein a square-shaped floatation collar 81 having a circular crossection uses air for buoyance, similar to that of FIGS. 6 and 7.

A free formed unsupported liner 82 comprises the body of the spa and is secured to the collar 81 by clamping bars 84. Seats 86 are inserted into the liner to give it shape and are constructed in three sections, A, B, and C for ease of installation. The sections can be clamped together or bolted to retain a smooth seating surface as best seen in FIG. 8. The spa 80 is provided with water inlet and outlet pipes 88 and 90, respectively, and an air delivery pipe 92 which supplies an air manifold 94 fastened beneath the seats 86 and a manifold 98 fastened to the feet of the seats. Holes 95 in the seats are designed to match those of the manifold 94 to allow the upward passage of air, and similarly holes 100 in the vertical part of the feet permit air to pass from manifold 98 into the lower portion of the spa. A connecting pipe 102 feeds air from the delivery pipe 92 to the manifold 98.

Figure 10:
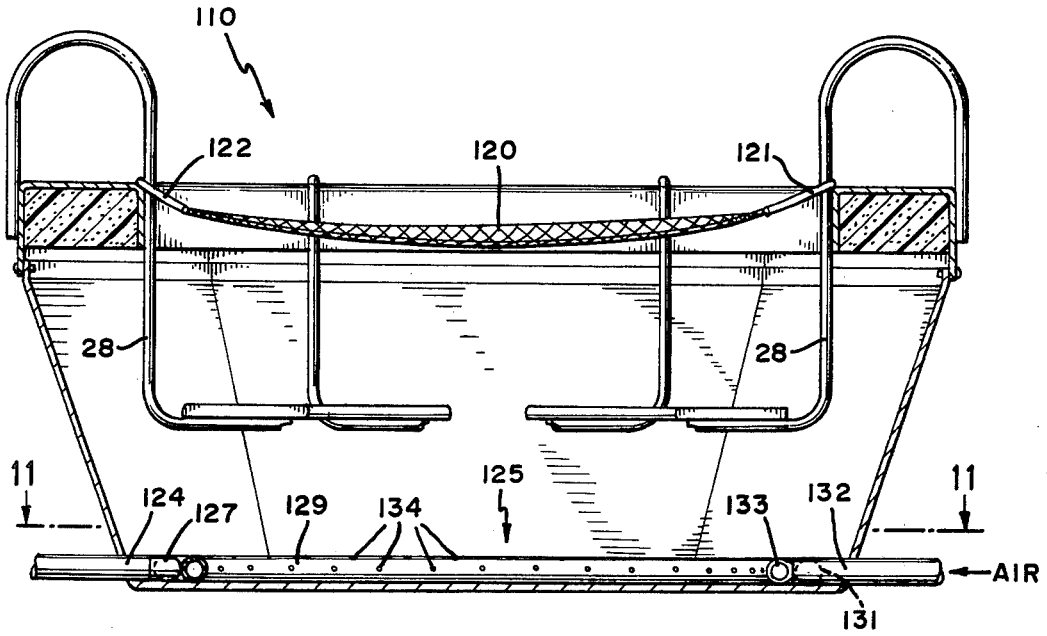
FIG. 10 is a sectional view of still another embodiment of spa constructed in accordance with the invention and illustrating a preferred combined air-water ring arrangement.

A modification of the spa of FIGS. 1 through 4 is illustrated in FIG. 10 wherein a hammock 120 is suspended across the top of the spa 110 and is attached at either end to the tubular members 28 by means of ropes 121 and 122. The ropes are of sufficient length to allow adjustability of the hammock 120 to greater or lesser depth beneath the surface of the water in the spa to support a user in a horizontal position best suited to the individual.

Figure 11:
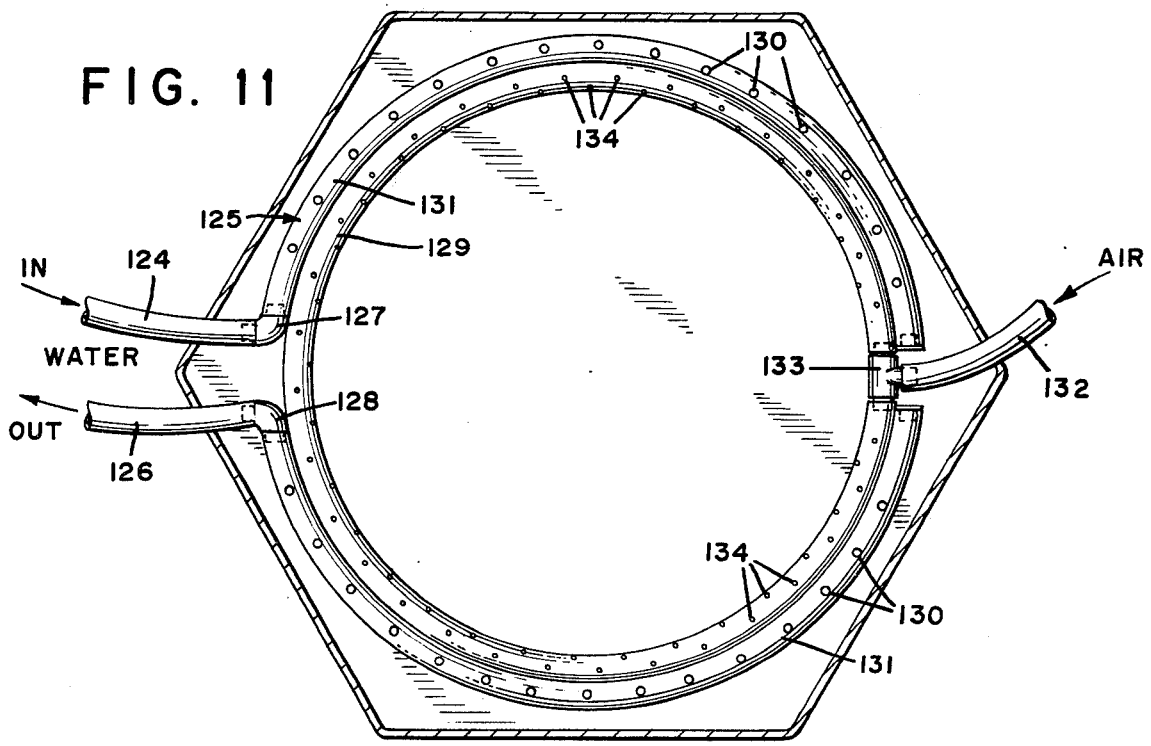
FIG. 11 is a sectional view taken along line 11—11 of FIG. 10.

The air and water manifold 125 illustrated in FIGS. 10 and 11, comprises an air-water manifold in which an air ring 129 is concentrically positioned within a water ring 131. As shown, as water enters the manifold through line 124 and is withdrawn through line 126. The lines are secured to the ring through suitable couplings 127 and 128, respectively, preferably using a flexible coupling especially where a movable floating spa embodiment is used. The air ring 129 is located concentrically within the water ring 131 and is fed through the line 132. Suitable openings 130 and 134 distribute the water and air respectively around the periphery of the base of the spa. It will be apparent that this concentric arrangement may be modified so that the outer ring comprises the air supply while the inner ring comprises the heated water supply. The concentric arrangement may be arranged to hold the shape of the spa and to offset any tendency of the floor of the spa of float.

While the present embodiments have been concerned with particular structures, it will be understood that many variations in construction and arrangement may be made without departing from the scope of the invention as defined in the appended claims.

We claim:

1. A floating therapy apparatus adapted to be floated and supported within a conventional swimming pool comprising a substantially water impermeable enclosure which is immersible in a swimming pool and adapted to have only the upper peripheral edge of said enclosure above the surface of said pool, a water inlet to bring filtered water from said pool filtration system into said enclosure, and a water outlet to discharge water from said enclosure, valving means for diverting at least a major proportion of the capacity of the swimming pool heater water into said enclosure, an air discharge means introduced below the water surface of said enclosure to receive air and create pressure waves in said enclosure and a blower means for supplying air into said enclosure through said air discharge opening.

2. The apparatus of claim 1 wherein the enclosure is comprised of flexible vinyl plastic composition.

3. The apparatus of claim 1 wherein the enclosure is comprised of a substantially rigid preformed plastic composition.

4. The apparatus of claim 1 wherein the upper periphery of said enclosure comprises a substantially rigid synthetic resin foam composition.

5. The apparatus of claim 1 wherein said enclosure is provided with a seat.

6. The apparatus of claim 1 wherein said air discharge means comprises a manifold-like member with a plurality of air discharge openings.

7. The apparatus of claim 6 wherein said manifold substantially follows the contour of the enclosure bottom.

8. The apparatus of claim 1 wherein said enclosure is equipped with means to at least temporarily secure said enclosure contiguous to the pool perimeter.

9. The apparatus of claim 8 wherein said enclosure is further provided with a safety rail to guide occupants into said enclosure.

10. The apparatus of claim 1 wherein a module comprising an inner concentric air ring and an outer concentric water ring is used to supply the air for the pressure waves and for the heated water respectively.

11. A portable hydrotherapy pool adapted to be supported in a surrounding body of water comprising a floating peripheral collar and depending from said collar a substantially water impermeable flexible enclosure attached to and depending from said collar to contain occupants therein, and having its lower portion which contains occupants immersed below the surface of the surrounding body of water, said enclosure containing at the base thereof air and water manifolds which introduce pressurized air and heated water respectively into said enclosure.

12. The hydrotherapy pool of claim 11 wherein said collar is formed from a plurality of cooperating floatation modules.

13. The hydrotherapy pool of claim 12 wherein the collar is hexagonal.

14. The hydrotherapy pool of claim 11 wherein said enclosure depending from said collar is a synthetic resinous sheet liner.

15. The hydrotherapy pool of claim 14 wherein the air and water manifolds are concentrically formed and serve additionally as a framing element to retain the geometrical shape of said pool and to offset buoyancy of the lower portion of said pool.

* * * * *